United States Patent [19]

Walden et al.

[11] Patent Number: 4,870,413

[45] Date of Patent: Sep. 26, 1989

[54] VEHICLE POSITIONING INDICATOR DEVICE

[76] Inventors: William E. Walden, 3617 Piermont NE; J. Howard Deme, 4804 Basen Ct. NE, both of, Albuquerque, N. Mex. 87111

[21] Appl. No.: 174,154

[22] Filed: Mar. 28, 1988

[51] Int. Cl.[4] ..... G08G 1/14

[52] U.S. Cl. ..... 340/932.2; 116/35 R

[58] Field of Search ..... 340/51, 932.2; 116/35 R, 58 A, 58 R; 200/D35, 153 C

[56] References Cited

U.S. PATENT DOCUMENTS

| | | | |
|---|---|---|---|
| 2,931,010 | 3/1960 | Geiser | 340/51 |
| 3,026,508 | 3/1962 | Muller | 340/51 |
| 3,509,527 | 4/1970 | Oakes et al. | 340/51 |
| 3,530,432 | 9/1970 | Pope | 340/51 |
| 3,820,065 | 6/1974 | Koplewicz et al. | 340/51 |
| 3,950,725 | 4/1976 | Kitajima | 340/51 |
| 4,101,868 | 7/1978 | Bubnich et al. | 340/51 |
| 4,318,077 | 3/1982 | Bubnich et al. | 340/51 |

FOREIGN PATENT DOCUMENTS

| | | | |
|---|---|---|---|
| 2384308 | 11/1978 | France | 340/51 |

*Primary Examiner*—Joseph A. Orsino
*Assistant Examiner*—Jill D. Jackson
*Attorney, Agent, or Firm*—Harpman & Harpman

[57] ABSTRACT

A self contained electronic vehicle parking device that indicates the relative position of a vehicle in a garage to the operator. A multiple timing circuit is provided to preset indicator activation time and reset the circuit for the next use.

5 Claims, 1 Drawing Sheet

VEHICLE POSITIONING INDICATOR DEVICE

BACKGROUND OF THE INVENTION

1. Technical Field:

This invention relates to parking aid devices that are activated by the vehicle as it parks in a garage. The devices provide a visual or audio warning to the driver indicating that the vehicle is properly positioned.

2. Description of Prior Art:

Prior Art devices of this type have used a variety of different activation and signaling mechanisms to indicate the vehicles relative position, see for example U.S. Pat. Nos. 3,820,065, 4,145,681 and 4,318,077.

In U.S. Pat. No. 3,820,065 a parking aid is disclosed that uses a light bulb activated by spring urged feeler that extends from the device mounted on the front wall of the garage. A battery provides power energizing the light upon movement of the feeler activating the circuit.

U.S. Pat. No. 4,145,681 shows a parking guide signaling device for cars having an enclosure with a lightbulb and reflector with an extending activation lever. As the vehicle approaches it moves a lever activating the warning light.

In U.S. Pat. No. 4,318,077 a vehicle parking aid and signaling device is disclosed having a light source that is activated by the closing of a switch. A deformable member is engaged by the vehicle inflating an elastic bulb within the d evice closing the switch activating the warning circuitry and associated light source.

SUMMARY OF THE INVENTION

A self-contained electronic vehicle parking device that signals the vehicle's driver the relative position of the vehicle within the parking garage. The device comprises a power source interconnected to a pre-programmed electronic circuit that allows for single or multiple activation by a self-contained floor mounted pressure switch. The device indicates initial postion of the vehicle and warns of continued advancement of the vehicle.

DESCRIPTION OF THE PREFERRED EMBODIMENT

Figure 1:
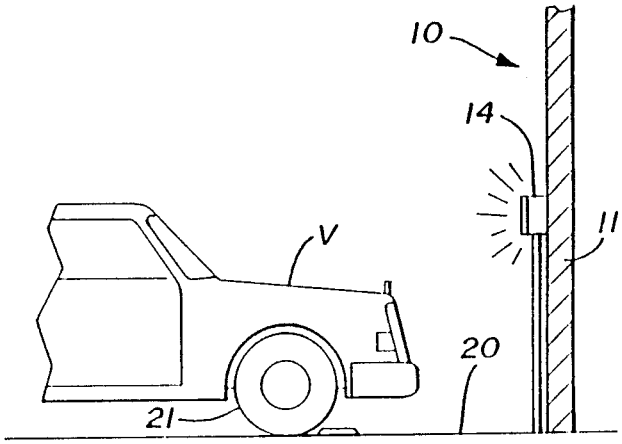
FIG. 1 is a graphic representation of a vehicle approaching a garage wall and the parking device.
Figure 2:
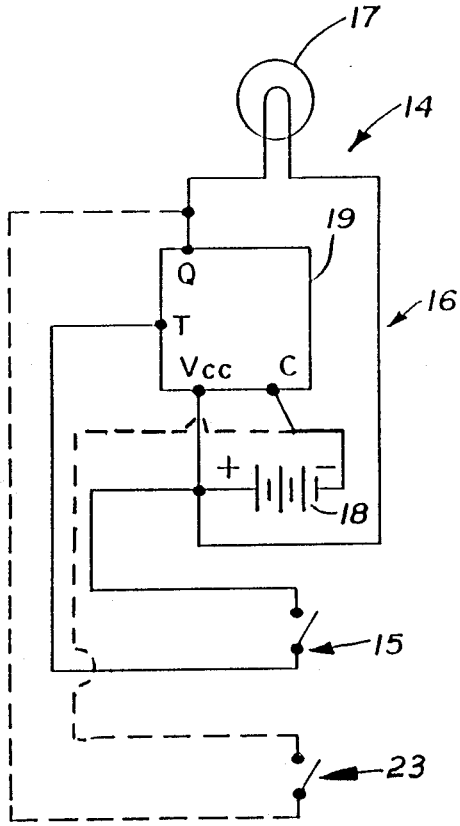
FIG. 2 is a schematic diagram of the eletronic circuit used in the device.
Figure 5:
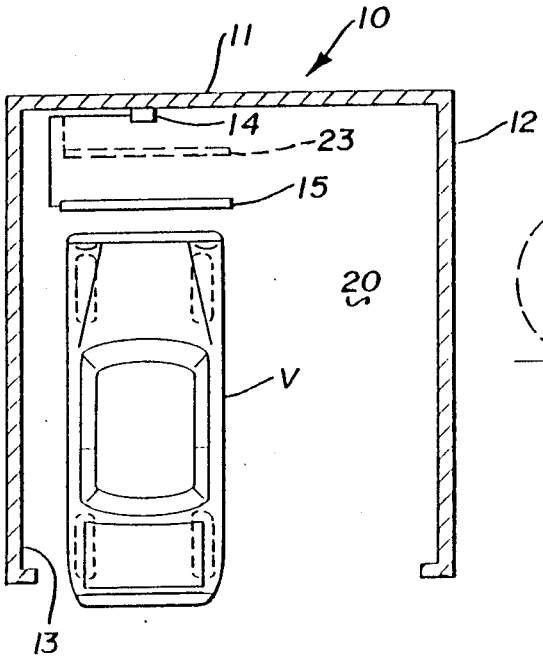
FIG. 5 is a top plan view of a representation of a vehicle and garage with the device positioned within.

Referring to FIGS. 1 and 2 of the drawings a vehicle parking device is disclosed for use in a parking garage 10 having a front wall 11 and an oppositely disposed side walls 12 and 13. A vehicle V is illustrated in FIGS. 1 and 5 of the drawings approaching the front wall 11. The vehicle parking device is comprised of an enclosure having a control and signaling unit 14 and a remote activation switch 15 interconnected therewith. The control and signaling unit 14 is best seen in FIG. 2 of the drawing having an electrical circuit 16 interconnected to a signal lamp 17 and a battery power source 18. A edge-triggered one-shot multivibrator 19 interconnects the above referred to components and is provided with power from the battery power source 18 at Vcc and c respectively. The switch 15 is of the low profile tpe and is positioned on a floor 20 of the garage 10, best seen in FIGS. 1 and 5 of the drawings. The switch 15 is connected to the battery power source 18 and the ultivibrator 19 at T. The signaling lamp 17 is connected to the battery power source 18 and a terminal Q of the multivibrator 19. It will be evident from the above description that activation of the switch 15 closes the power circuit and activates the multivibrator 19 applying power activating (in this embodiment) the signal lamp 17.

Figure 3:
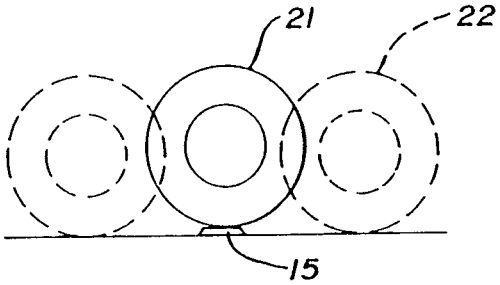
FIG. 3 is a tire position diagram indicating approach, activation and deactivation of a portion of the device.

A predetermined delay within the multivibrator 19 will then remove power deactivating the lamp 17. This condition is illustrated in FIG. 3 of the drawings wherein a vehicle's tire 21 shown in solid lines is engaged on the switch 15. The set delay chosen in this example is 15 seconds which is sufficient time for the driver to stop the vehicle V in a predetermined safe distance from the wall 11. Should the vehicle V tire 21 move away and off the switch 15 as seen in FIG. 3 in broken lines at 22 before the expiration of the predetermined time then the power to the signal device 17 via the output Q would be turned off deactivating the signal lamp indicating to the vehicle V operator that the vehicle has travelled too far and is in immediate danger of impacting into the garage wall 11.

Only after the vehicle's V tire 21 disengages the switch 15 does the circuit reset to a wait further activation as seen in FIG. 3 by the positioning of the tire 22 in broken lines.

Figure 4:
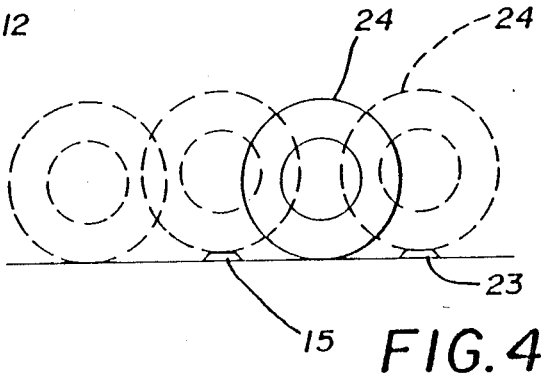
FIG. 4 is a tire posititoning diagram showing an alternate form of the invention.

Referring now to FIGS. 2 and 4 of the drawings an alternate form of the invention is shown wherein a secondary switch 23 is disclosed in broken lines interconnected to the power battery source circuit directly so that upon activation by engagement of a tire 24 (shown in broken lines) the signal lamp 17 will be activated. The continuous non-timed activation of the signal lamp 17 by the secondary switch 23 warns the vehicle's operator to stop and back up the vehicle prior to impact with the wall. The operator can reposition the vehicle so that the tire 24 will rest as shown in solid lines in FIG. 4 of the drawings.

Thus, it will be seen that a new and useful vehicle parking indicator has been illustrated and described and that it will be apparent to those skilled in the art that various changes and modifications may be made therein without departing from the spirit of the invention, therefore I claim:

I claim:

1. A vehicle positioning indicator device to position a vehicle within a predetermined parking space within a parking garage, means for activating said vehicle positioning indicator device, said parking garage comprises a front wall and oppositely disposed side walls and a floor, said vehicle position device comprises an enclosed enclosure secured to said front wall, a control and signal unit within said enclosure, a self-contained power source within said enclosure interconnected to said control and signal unit, an elongated pressure sensitive switch positioned on said floor in spaced parallel relation to said front wall, means for interconnecting said switch to said control and signal unit and said power source, said control and signal unit comprises an electronic circuit having an edge-triggered one-shot multi-vibrator having multiple inputs, a lamp interconnected to one of said inputs and to the self-contained power source.

2. The vehicle positioning indicator device of claim 1 wherein said means for interconnecting said switch to said control and signal unit is an electronic circuit connected to one of said inputs, and said power source.

3. The vehicle parking device of claim 1 wherein said means for activating said vehicle positioning indicator device comprise a vehicle's tire engaging said switch anywhere along its length.

4. The vehicle positioning indicator device of claim 1 wherein said self-contained power source is a battery.

5. A vehicle positioning indicator device to position a vehicle within a predetermined parking space within a parking garage, means for selectively activating said vehicle positioning indicator device, said vehicle positioning indicator device comprises an enclosure having a control and signal unit and a self-contained power source and a lamp within, a pair of spaced elongated pressure sensitive switches, one of said switches interconnected to said control and signal unit and said power source, the other of said switches connected to the power source and said lamp within said enclosure, the control and signal unit comprises an on-edge one-shot multi-vibrator, an electronic circuit interconnecting said multi-vibrator, said power source, said lamp and one of said switches,.

* * * * *